US005488749A

United States Patent [19]

Pearce et al.

[11] Patent Number: 5,488,749

[45] Date of Patent: Feb. 6, 1996

[54] SINK AND DISPOSAL CLEANING TOOL

[76] Inventors: Patricia Pearce; Charles Pearce, both of 1120 Mainsail Dr., Annapolis, Md. 21403

[21] Appl. No.: 354,484

[22] Filed: Dec. 12, 1994

[51] Int. Cl.[6] ..... A47L 25/00

[52] U.S. Cl. ..... 15/105; 15/236.01; 7/170; 81/488; 294/1.1; D32/42; D32/49

[58] Field of Search ..... 15/104.001, 105, 15/236.01; 4/286, 295; 294/1.1, 2, 24; 7/169, 170; 81/488; D32/35, 42, 46, 49

[56] References Cited

U.S. PATENT DOCUMENTS

| | | | |
|---|---|---|---|
| Re. 32,141 | 5/1986 | Cosner | 15/236.01 |
| D. 269,302 | 6/1983 | Auerbach | 15/105 |
| 2,772,430 | 12/1956 | Moritt | 15/236.01 |
| 3,427,636 | 2/1969 | Seifert | 15/105 |
| 3,765,275 | 10/1973 | Johnson | 15/105 |
| 3,780,393 | 12/1973 | Gaetke | 15/105 |
| 4,137,578 | 2/1979 | Felici | 15/105 |
| 4,268,080 | 5/1981 | Lindley | 15/105 |
| 4,297,761 | 11/1981 | Loos | 15/105 |
| 4,409,692 | 10/1983 | Ness | 15/105 |
| 4,504,996 | 3/1985 | Loos | 15/105 |
| 4,745,642 | 5/1988 | Shanos | 15/105 |

*Primary Examiner*—Mark Spisich

[57] ABSTRACT

A tool for facilitating cleaning of a sink and positioning of food debris into a garbage disposal. The inventive device includes a handle having a scraping assembly extending from a first end thereof for scraping food from a surface of the sink. A plunger assembly extends from a second end of the handle for facilitating positioning of food debris into a garbage disposal of the associated sink.

6 Claims, 3 Drawing Sheets

SINK AND DISPOSAL CLEANING TOOL

BACKGROUND OF THE INVENTION

1. Field of the Invention

The present invention relates to cleaning implements and more particularly pertains to an sink and disposal cleaning tool for facilitating cleaning of a sink and positioning of food debris into a garbage disposal thereof.

2. Description of the Prior Art

The use of cleaning implements is known in the prior art. More specifically, cleaning implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning implements include U.S. Pat. No. 4,297,761; U.S. Pat. No. 4,395,792; U.S. Pat. No. 4,504,996; U.S. Pat. No. Design 266,963; U.S. Pat. No. Design 269,302; U.S. Pat. No. Design 269,471; and U.S. Pat. No. Design 274,273.

While these devices fulfill their respective, particular objectives and requirements, the aforementioned patents do not disclose a sink and disposal cleaning tool for facilitating cleaning of a sink and positioning of food debris into a garbage disposal which includes a handle having a scraping assembly extending from a first end thereof for scraping food from a surface of the sink, and a plunger assembly extending from a second end of the handle for facilitating positioning of food debris into a garbage disposal of the associated sink.

In these respects, the sink and disposal cleaning tool according to the present invention substantially departs from the conventional concepts and designs of the prior art, and in so doing provides an apparatus primarily developed for the purpose of facilitating cleaning of a sink and positioning of food debris into a garbage disposal.

SUMMARY OF THE INVENTION

In view of the foregoing disadvantages inherent in the known types of cleaning implements now present in the prior art, the present invention provides a new sink and disposal cleaning tool construction wherein the same can be utilized for facilitating cleaning of a sink and positioning of food debris into a garbage disposal. As such, the general purpose of the present invention, which will be described subsequently in greater detail, is to provide a new sink and disposal cleaning tool apparatus and method which has many of the advantages of the cleaning implements mentioned heretofore and many novel features that result in a sink and disposal cleaning tool which is not anticipated, rendered obvious, suggested, or even implied by any of the prior art cleaning implements, either alone or in any combination thereof.

To attain this, the present invention generally comprises a tool for facilitating cleaning of a sink and positioning of food debris into a garbage disposal. The inventive device includes a handle having a scraping assembly extending from a first end thereof for scraping food from a surface of the sink. A plunger assembly extends from a second end of the handle for facilitating positioning of food debris into a garbage disposal of the associated sink.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sink and disposal cleaning tool apparatus and method which has many of the advantages of the cleaning implements mentioned heretofore and many novel features that result in a sink and disposal cleaning tool which is not anticipated, rendered obvious, suggested, or even implied by any of the prior art cleaning implements, either alone or in any combination thereof.

It is another object of the present invention to provide a new sink and disposal cleaning tool which may be easily and efficiently manufactured and marketed.

It is a further object of the present invention to provide a new sink and disposal cleaning tool which is of a durable and reliable construction.

An even further object of the present invention is to provide a new sink and disposal cleaning tool which is susceptible of a low cost of manufacture with regard to both materials and labor, and which accordingly is then susceptible of low prices of sale to the consuming public, thereby making such sink and disposal cleaning tools economically available to the buying public.

Still yet another object of the present invention is to provide a new sink and disposal cleaning tool which provides in the apparatuses and methods of the prior art some of the advantages thereof, while simultaneously overcoming some of the disadvantages normally associated therewith.

Still another object of the present invention is to provide a new sink and disposal cleaning tool for facilitating cleaning of a sink and positioning of food debris into a garbage disposal thereof.

Yet another object of the present invention is to provide a new sink and disposal cleaning tool which includes a handle having a scraping assembly extending from a first end thereof for scraping food from a surface of the sink, and a plunger assembly extending from a second end of the handle for facilitating positioning of food debris into a garbage disposal of the associated sink.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
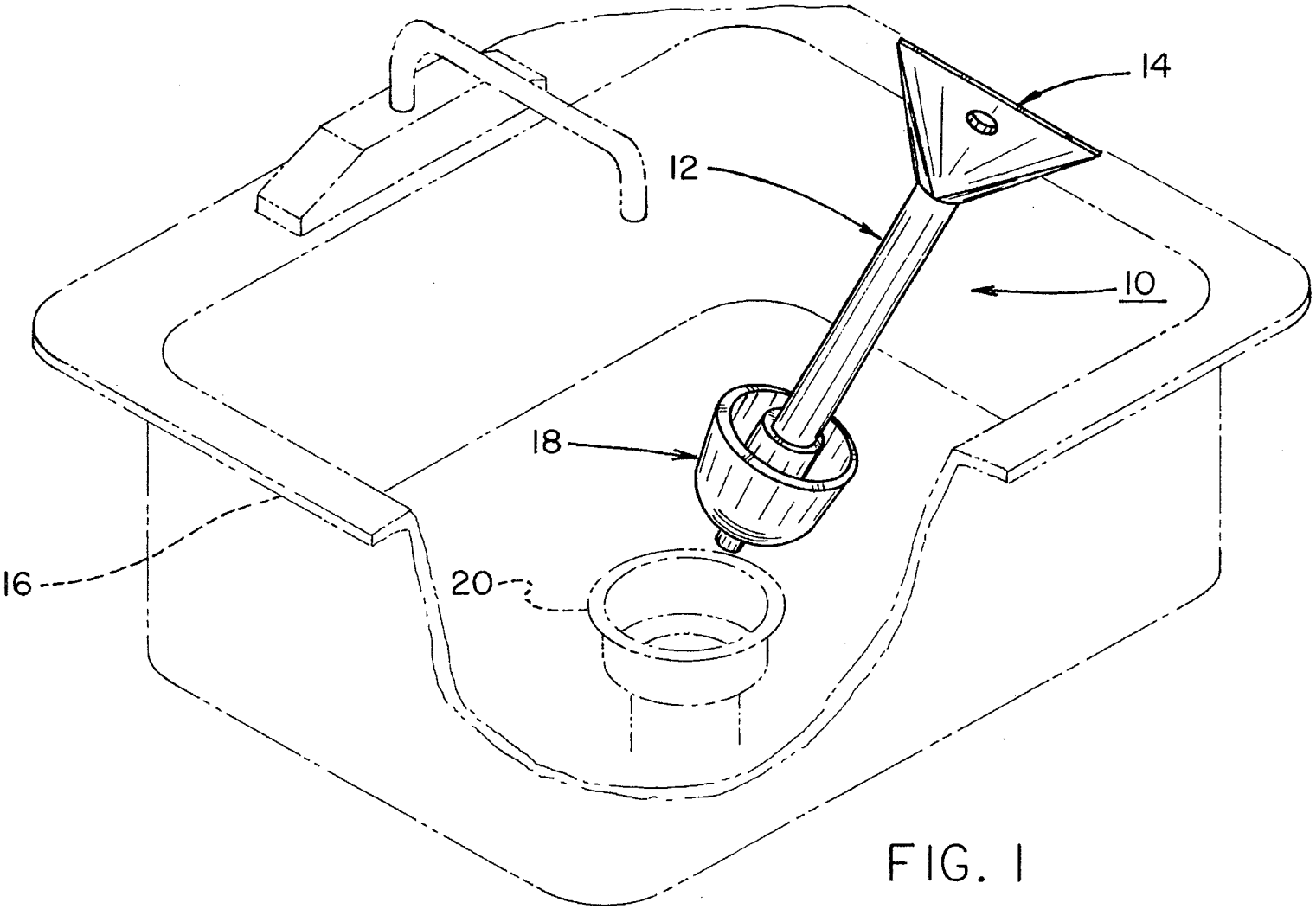
FIG. 1 is an isometric illustration of a sink and disposal cleaning tool according to the present invention in use.

With reference now to the drawings, and in particular to FIGS. 1–5 thereof, a new sink and disposal cleaning tool embodying the principles and concepts of the present invention and generally designated by the reference numeral 10 will be described.

More specifically, it will be noted that the sink and disposal cleaning tool 10 comprises a handle means 12 for being grasped and manipulated by an individual. A scraping means 14 is coupled to a first end of the handle means 12 and operable for scraping food or like substances from a surface of a sink 16. A plunger means 18 is secured to a second end of the handle means 12 and operable for positioning food debris or the like through a drain opening 20 of the sink 16 for consumption by an unlabeled garbage disposal of the sink.

Figure 2:
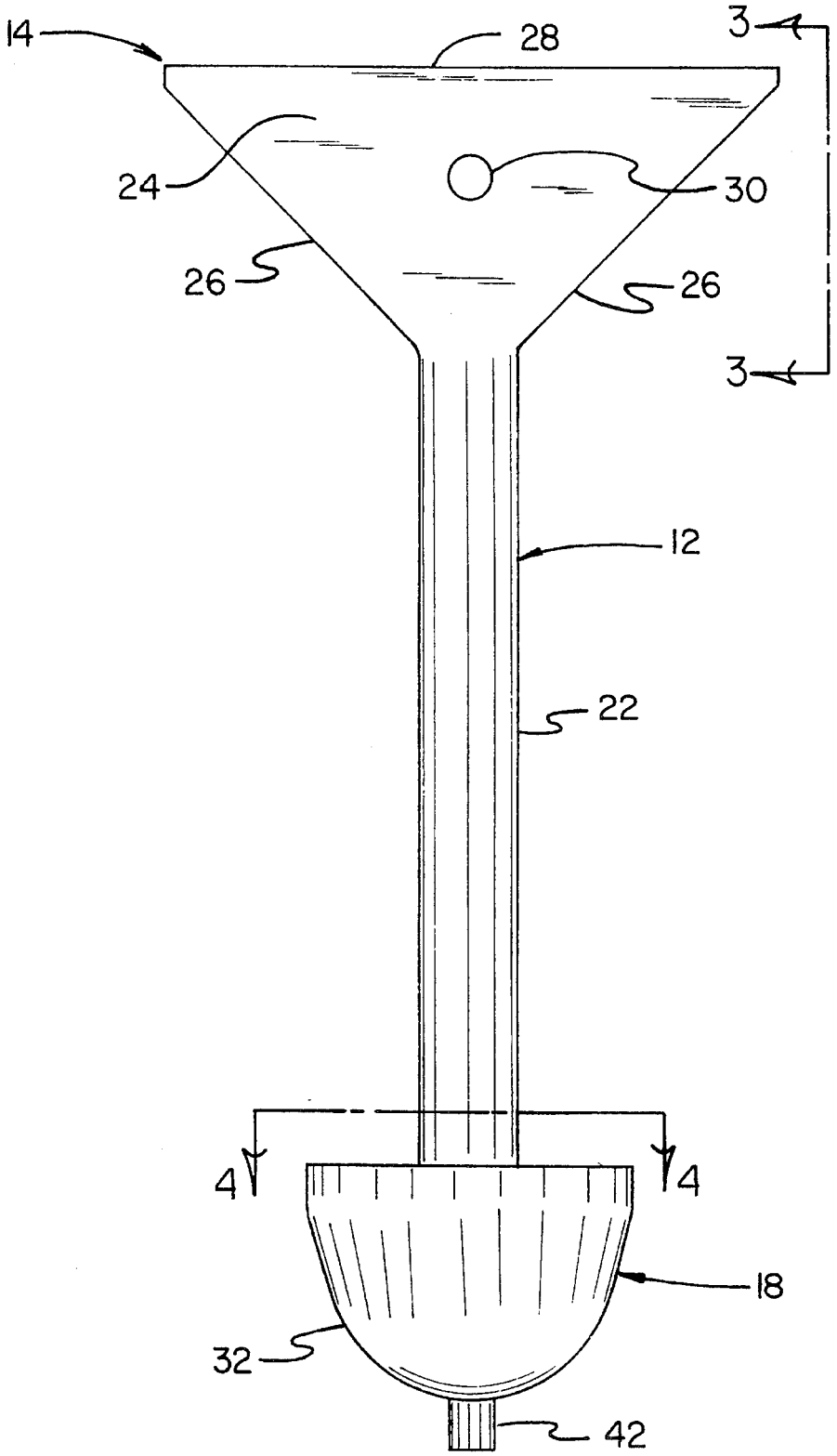
FIG. 2 is a front elevation view thereof.
Figure 3:
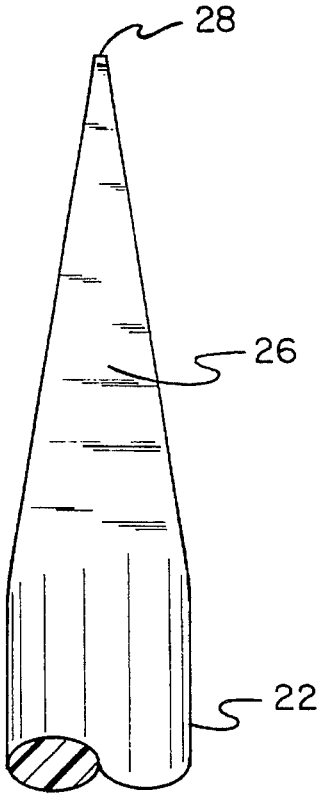
FIG. 3 is a side elevation view taken from line 3—3 of FIG. 2.

As best illustrated in FIGS. 2 and 3, it can be shown that the handle means 12 according to the present invention 10 comprises a substantially elongated member 22. The elongated member 22 may be of any cross sectional configuration, but is preferably substantially circular in cross section as shown in the drawings.

With continuing reference to FIGS. 2 and 3, it can be shown that the scraping means 14 according to the present invention 10 preferably comprises a tapered scraping blade 24 projecting from a first end of the elongated member 22 of the handle means 12, with the scraping blade 24 preferably being integrally formed with the elongated member 22. The tapered scraping blade 24 thus comprises a pair of angled lateral edges 26 projecting at an oblique angle from the elongated member 22 of the handle means 12. A straight scraping edge 28 intersects the angled lateral edges 26 and cooperates therewith to define a substantially triangular shape of the scraping blade 24. The scraping blade 24 may be shaped so as to define a mounting aperture 30 extending therethrough permitting hanging of the device 10 from a support hook or the like. By this structure, the straight edge 28 of the tapered scraping blade 24 can be engaged to a surface of the sink 16 to effect scraping and mechanical removal of food or like items therefrom.

Figure 4:
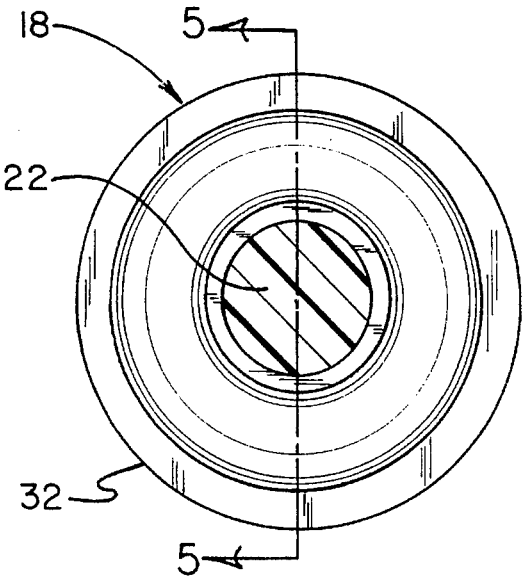
FIG. 4 is a cross sectional view taken along line 4—4 of FIG. 2.
Figure 5:
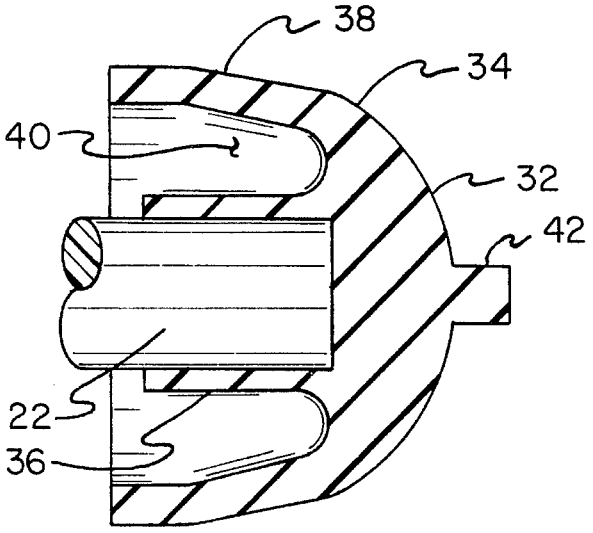
FIG. 5 is a cross sectional view taken along line 5—5 of FIG. 4.

As best illustrated in FIGS. 2, 4, and 5, it can be shown that the plunger means 18 according to the present invention 10 preferably comprises an arcuate cup member 32 secured to a second end of the elongated member 22 of the handle means 12. As shown in the cross section illustration of the FIG. 5, the arcuate cup member 32 comprises a solid arcuate member 34 having a mounting cylinder 36 projecting therefrom. The mounting cylinder 36 is substantially hollow in configuration and receives the second end of the elongated member 22 therewithin, whereby adhesives or mechanical fasteners can be further utilized to secure the arcuate cup 32 to the elongated member 22. An annular side wall 38 projects from the solid arcuate member 34 into a substantially concentric relationship relative to the mounting cylinder 36 and cooperates therewith to define an annular compression space 40 permitting radially inward deformation of the annular side wall 38 during use of the plunger means 18. As shown in FIGS. 2 and 5, the solid arcuate member 34 is shaped so as to define a limiting projection 42 extending therefrom and oriented co-linearly with a longitudinal axis of the elongated member 22. The limiting projection 42 operates to engage a center portion of an impeller blade of an unillustrated garbage disposal to preclude contact of the solid arcuate member 34 of the arcuate cup 32 with the mulching blades of the garbage disposal. Thus, the limiting projection 42 permits an individual to use the device 10 while the garbage disposal is energized to effect positioning of food items and like material through the drain opening 20 and into the garbage disposal.

In use, the sink and disposal cleaning tool according to the present invention 10 can be easily utilized to effect cleaning of an associated sink 16. To this end, the scraping means 14 can be utilized to scrape and mechanically remove food from the sink 16, while the plunger means 18 is operable to bias food debris and the like through the drain opening 20 and into the garbage disposal for consumption thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sink and disposal cleaning tool comprising:

a handle means for being grasped and manipulated by an individual;

a scraping means coupled to a first end of the handle means for scraping substances from a surface of a sink;

a plunger means secured to a second end of the handle means for positioning debris through a drain opening of a sink for consumption by a garbage disposal of the sink;

wherein the handle means comprises a substantially elongated member having said first end and said second end at opposite ends thereof;

wherein the scraping means comprises a tapered scraping blade projecting from the first end of the elongated member of the handle means, the tapered scraping blade including a pair of angled lateral edges projecting at an oblique angle from the elongated member of the handle means; and a straight scraping edge intersecting the angled lateral edges and cooperating therewith to define a substantially triangular shape of the scraping blade;

wherein the plunger means comprises an arcuate cup member secured to the second end of the elongated member of the handle means;

wherein the arcuate cup member comprises a solid arcuate member having a mounting cylinder projecting therefrom, the mounting cylinder being substantially hollow in configuration and receiving the second end of the elongated member therewithin; and an annular side wall projecting from the solid arcuate member into a substantially concentric relationship relative to the mounting cylinder, the annular side wall cooperating with the mounting cylinder to define an annular compression space permitting radially inward deformation of the annular side wall.

2. The sink and disposal cleaning tool of claim 1, wherein the solid arcuate member is shaped so as to define a limiting projection means extending therefrom and oriented colinearly with a longitudinal axis of the elongated member for engaging a center portion of an impeller blade of a garbage disposal to preclude contact of the solid arcuate member of the arcuate cup with mulching blades of the impeller blade of the garbage disposal.

3. The sink and disposal cleaning tool of claim 2, wherein the scraping blade is shaped so as to define a mounting aperture extending therethrough.

4. A sink and disposal cleaning tool comprising:

a handle means for being grasped and manipulated by an individual;

a scraping means coupled to a first end of the handle means for scraping substances from a surface of a sink;

a plunger means secured to a second end of the handle means for positioning debris through a drain opening of a sink for consumption by a garbage disposal of the sink;

wherein the handle means comprises a substantially elongated member having said first end and said second end at opposite ends thereof;

wherein the plunger means comprises an arcuate cup member secured to the second end of the elongated member of the handle means;

wherein the arcuate cup member comprises a solid arcuate member having a mounting cylinder projecting therefrom, the mounting cylinder being substantially hollow in configuration and receiving the second end of the elongated member therewithin; and an annular side wall projecting from the solid arcuate member into a substantially concentric relationship relative to the mounting cylinder, the annular side wall cooperating with the mounting cylinder to define an annular compression space permitting radially inward deformation of the annular side wall.

5. The sink and disposal cleaning tool of claim 4, wherein the solid arcuate member is shaped so as to define a limiting projection means extending therefrom and oriented colinearly with a longitudinal axis of the elongated member for engaging a center portion of an impeller blade of a garbage disposal to preclude contact of the solid arcuate member of the arcuate cup with mulching blades of the impeller blade of the garbage disposal.

6. The sink and disposal cleaning tool of claim 5, wherein the scraping means comprises a tapered scraping blade projecting from the first end of the elongated member of the handle means, and further wherein the scraping blade is shaped so as to define a mounting aperture extending therethrough.

* * * * *